US006994333B2

(12) United States Patent
Lobry et al.

(10) Patent No.: US 6,994,333 B2
(45) Date of Patent: Feb. 7, 2006

(54) SUSPENSION DEVICE FOR A BED OR SEAT BASE OF THE MULTIELEMENT TYPE

(75) Inventors: Jacques Lobry, Bourges (FR); Françoise Lobry, Bourges (FR)

(73) Assignee: Tournadre Sa Standard Gum, Bourges (FR)

( * ) Notice: Subject to any disclaimer, the term of this patent is extended or adjusted under 35 U.S.C. 154(b) by 34 days.

(21) Appl. No.: 10/133,663

(22) Filed: Apr. 26, 2002

(65) Prior Publication Data

US 2002/0163114 A1 Nov. 7, 2002

(30) Foreign Application Priority Data

May 2, 2001 (FR) ..... 01 05861

(51) Int. Cl.
*F16F 1/00* (2006.01)

(52) U.S. Cl. ..... 267/145; 267/153; 267/160; 267/103

(58) Field of Classification Search ..... 267/141, 267/142, 145, 153, 160, 164, 103; 5/719, 5/247, 255

See application file for complete search history.

(56) References Cited

U.S. PATENT DOCUMENTS

| | | | | |
|---|---|---|---|---|
| 122,111 | A * | 12/1871 | Duffy | 5/255 |
| 124,436 | A * | 3/1872 | Guest | 5/230 |
| 5,149,066 | A * | 9/1992 | Snaith et al. | 267/136 |
| 5,426,799 | A * | 6/1995 | Ottiger et al. | 5/719 |
| 5,588,165 | A * | 12/1996 | Fromme | 5/247 |
| 5,632,473 | A | 5/1997 | Dias Magalhaes Queiroz | 267/164 |
| 6,427,990 | B1 * | 8/2002 | Hartmann | 267/158 |
| 6,435,490 | B1 * | 8/2002 | Monson et al. | 267/141 |
| 6,477,727 | B1 * | 11/2002 | Fromme | 5/247 |
| 6,533,258 | B2 * | 3/2003 | Monson et al. | 267/153 |

FOREIGN PATENT DOCUMENTS

| | | |
|---|---|---|
| DE | 299 03 423 U 1 | 5/1999 |
| DE | 200 01 616 U 1 | 3/2001 |
| DE | WO 01 15572 | 3/2001 |
| WO | WO 99/03379 * | 1/1999 |

* cited by examiner

*Primary Examiner*—Robert A. Siconolfi
*Assistant Examiner*—Bradley T. King
(74) *Attorney, Agent, or Firm*—Cohen, Pontani, Lieberman & Pavane

(57) ABSTRACT

The invention provides an individual suspension device for a bed or seat base of the multi-element type, the device being for interposing between a platform determining a support surface and a padding element such as a mattress, and comprising a foot for fixing to an element of the platform, a suspension structure fixed to the foot, and a top plate carried by the suspension structure and serving as a support for the padding element, said suspension structure being circularly symmetrical about a vertical axis, wherein the suspension structure is a single hollow piece and is made of a flexible synthetic material or a vulcanized rubber having hardness lying in the range 40 on the Shore A scale to 70 on the Shore D scale.

7 Claims, 13 Drawing Sheets

SUSPENSION DEVICE FOR A BED OR SEAT BASE OF THE MULTIELEMENT TYPE

The invention relates to a universal suspension device for a bed or a seat, for placing between a support surface and a padding element.

More precisely, the invention relates to an individual suspension device for a bed or seat base of the multi-element type, the device being for interposing between a platform determining a support surface and a padding element such as a mattress, and comprising a foot for fixing to an element of the platform, a suspension structure fixed to the foot, and a top plate carried by the suspension structure and serving as a support for the padding element, said suspension structure being circularly symmetrical about a vertical axis.

BACKGROUND OF THE INVENTION

In general, such individual suspension devices are placed in rows and columns and are fixed to rigid slats constituting the platform. The elements are commonly symmetrical about a transverse midplane and about a longitudinal midplane, and their hardness is not uniform, depending on the slope imparted to the top plate.

WO 01/15572 describes an individual suspension device comprising a foot and a suspension structure in which the suspension structure, on its own and at rest, is in the form of a central ring having a plurality of resilient radial arms diverging therefrom. The ends of these arms have means for fixing to a ring of the foot. After these arm ends have been assembled to the ring of the foot, the arms take up the shape of spherical sectors that are separated by lateral openings, but they are then subjected to elastic stress, and in the event of one of the fixing means breaking, they necessarily return to a radial position.

DE 29 903 423 presents the state of the art closest to the invention and it provides a hollow suspension structure of spherical shape made out of a foam of resilient synthetic material, having holes at its top and bottom ends for fixing to the foot and to the top plate by means of clips. After assembly, the suspension structure is normally airtight, and it functions like a balloon. The problem which arises is that of providing leaktightness around the holes.

OBJECTS AND SUMMARY OF THE INVENTION

Starting from that state of the art, the invention proposes a novel type of suspension in which the question of airtightness no longer arises.

The invention achieves this object by the suspension structure on its own and at rest being in the form of a one-piece hollow sphere comprising a plurality of sectors separated from one another by lateral openings and made of a flexible synthetic material or a vulcanized rubber of hardness lying in the range 40 on the Shore A scale to 70 on the Shore D scale.

Thus, only the wall of the suspension structure contributes to supporting compression and bending forces when a load is to be carried, and the inside of the structure is advantageously open to atmospheric pressure.

In order to make it easier to position the top plate relative to the foot and to the platform element, the foot has means for preventing it from turning after it has been fixed to the platform element.

The suspension structure and the top plate have co-operating means for connecting them together in traction and in rotation about the axis of symmetry of said suspension structure. These means preferably comprise a bayonet fixing system and a clip system.

The foot and the suspension structure can be made as a single piece. They can also be made as two separate pieces. In which case the suspension structure and the foot include co-operating means enabling them to be connected together in traction and in rotation about the axis of symmetry of said suspension structure.

The connection between the suspension structure and the foot can be implemented in various ways, either by a dovetail slideway system together with a clip system for locking the two pieces together after they have been assembled, or by a clip system with a tenon being positioned in a mortise, or by a bayonet system in combination with a clip system, or by a clamp device guided by a slideway during assembly, together with a device for locking against rotation and which takes up its position automatically at the end of assembly.

In any event, the mutual connection means are formed on the two pieces during molding thereof.

The suspension structure can be spherical and comprise sectors alternating with lateral openings that are regularly distributed about the axis of symmetry of said structure. The dimensions and the thickness of said sectors are determined as a function of the desired stiffness.

In order to modify the stiffness of the suspension structure, its internal cavity can contain a removable stiffening member placed on its axis of symmetry, said member advantageously having a plug at its top end which is received in a through orifice formed in a head for fixing the top plate and formed at the top end of the suspension structure.

BRIEF DESCRIPTION OF THE DRAWINGS

Other advantages and characteristics of the invention appear on reading the following description of various embodiments made with reference to the accompanying drawings, in which.

MORE DETAILED DESCRIPTION

Figure 1:
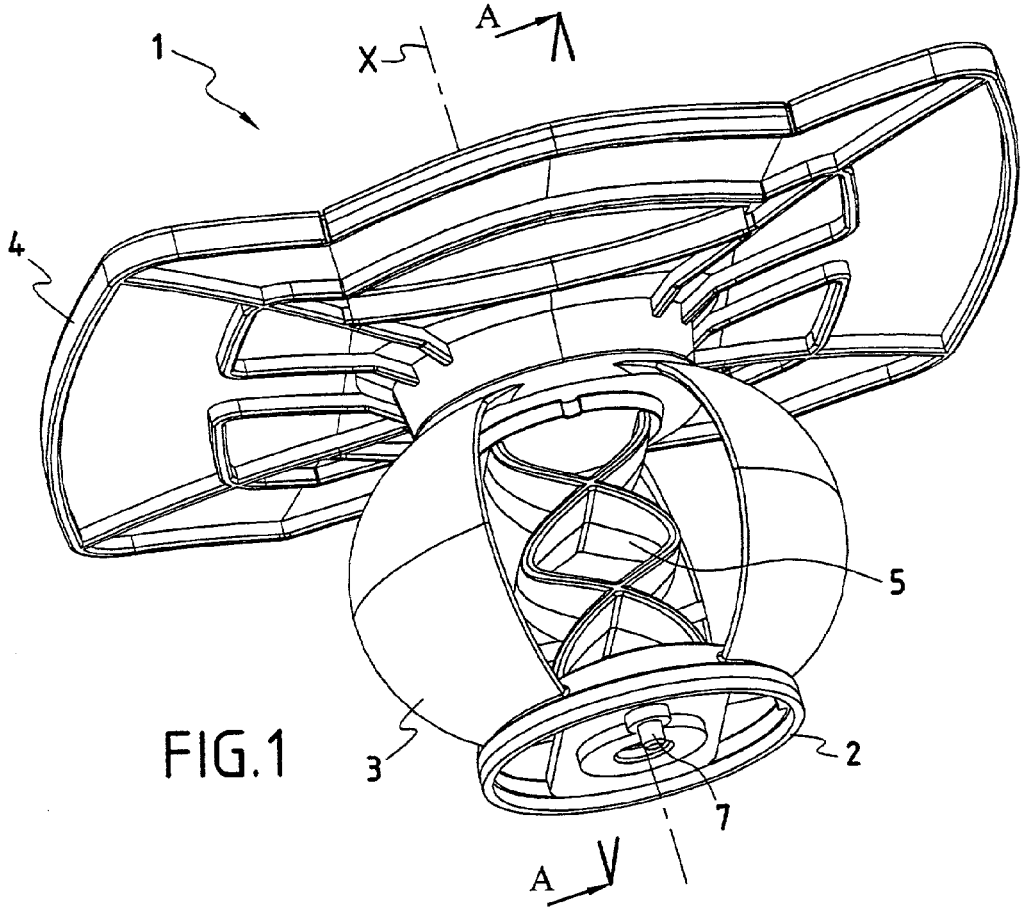
FIG. 1 is a perspective view of a first embodiment of a suspension device of the invention.
Figure 2:
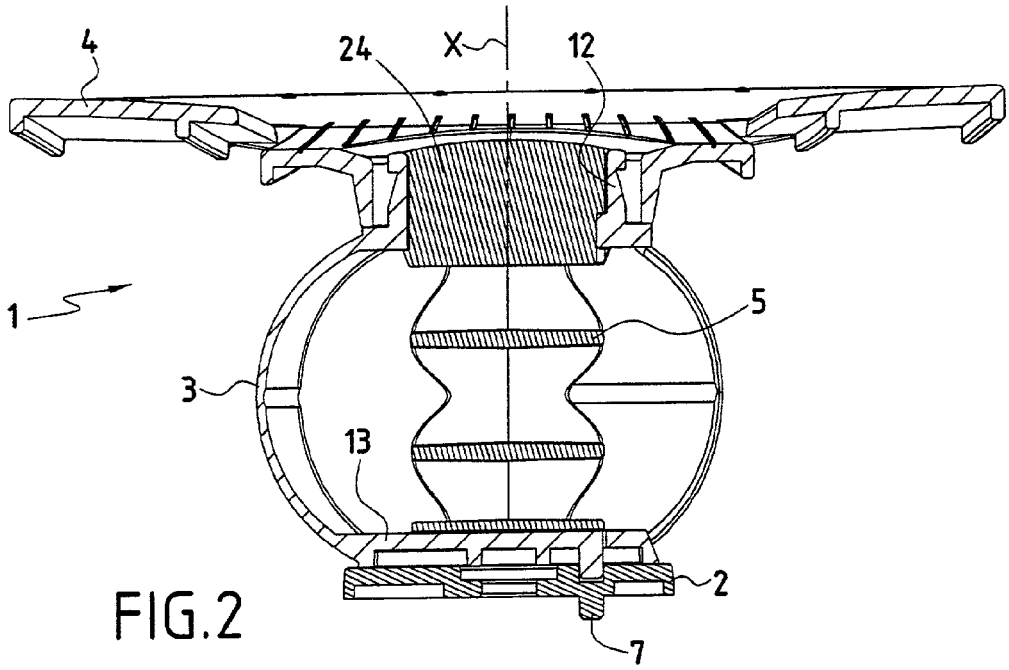
FIG. 2 is a section view on a vertical transverse plane through the FIG. 1 suspension device.

FIGS. 1 to 10 show an individual suspension device 1 of a multi-element base, for a seat or a bed for example, constituting a preferred embodiment of the invention. The suspension device 1 is for fixing to a slat of a support platform (not shown in the figures), and it essentially comprises three elements: a foot 2 for fixing to a slat, a suspension structure 3 mounted on the foot 2, and a top plate 4 carried by the suspension structure 3.

The plate 4 serves as a support for a padding element, e.g. a mattress which is not shown in the drawings. The suspension device 1 can also include a stiffening member 5 which enables the stiffness of the suspension device 1 to be modified depending on its position within the base. The base comprises a plurality of suspension devices disposed in juxtaposed rows and columns.

Figure 3:
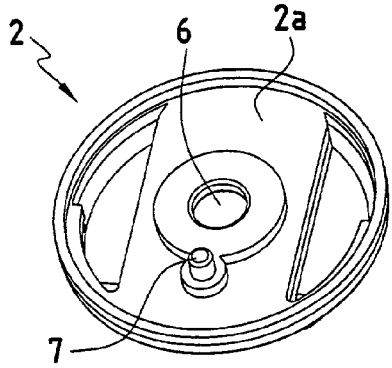
FIGS. 3 and 4 are perspective views showing respectively the bottom and top faces of the foot of the FIG. 1 device.
Figure 4:
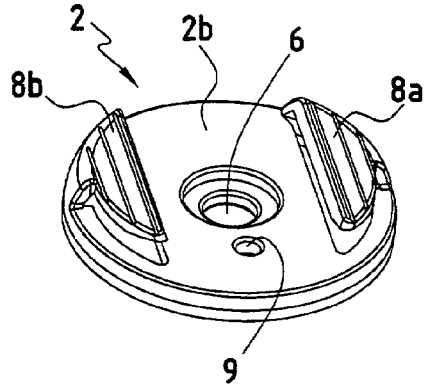

The foot 2 which is shown in detail in FIGS. 3 and 4 is made of a suitable rigid synthetic material such as polypropylene or polyamide, by molding, or else it is made of metal. It has a central orifice 6 enabling it to be fixed to a slat by means of a screw, and on its bottom face 2*a* it has a stud 7 for being received in a hole formed in the slat, so as to prevent the foot 2 from turning after it has been fixed to the slat. The foot 2 also includes, on its top face 2*b*, two lateral tongues 8*a* and 8*b* which extend in the same direction parallel to the slat, and it has a hole 9 located above the stud 7. The tongues 8*a* and 8*b* serve to retain the suspension structure 3, and the hole 9 serves to prevent the suspension structure 3 from moving, in particular from turning after it has been mounted, as explained below.

Figure 5:
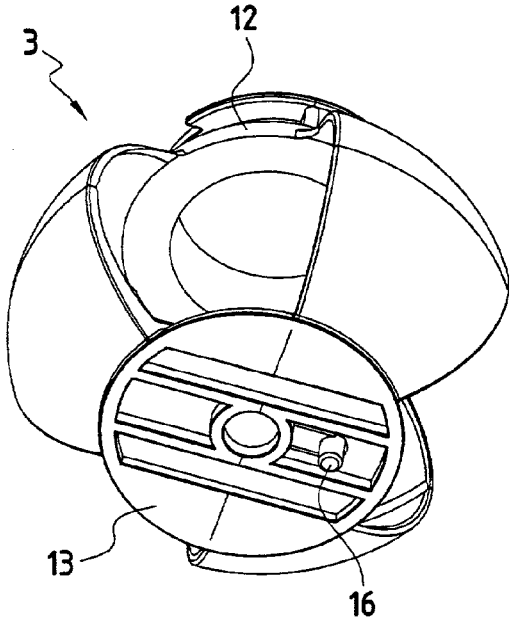
FIGS. 5 and 6 are perspective views respectively showing the bottom and top faces of the suspension structure of the FIG. 1 device.
Figure 6:
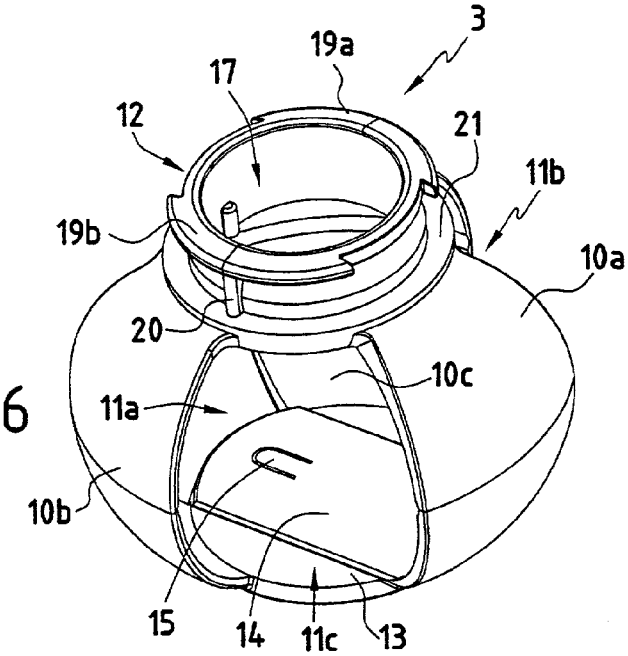

The suspension structure 3 shown in detail in FIGS. 5 and 6 is circularly symmetrical about a vertical axis X. It is made of a flexible synthetic material of the thermoplastic elastomer (TPE) type or a vulcanized rubber. The hardnesses of the materials are adapted to the loads that are to be supported. These hardnesses lie preferably in the range 40 on the Shore A scale to 70 on the Shore D scale. The suspension structure 3 is in the form of a sphere having three sectors 10*a*, 10*b*, 10*c* separated by three lateral openings 11*a*, 11*b*, 11*c* which are regularly spaced apart around the axis X. The circumferential extent of the sectors 10*a*, 10*b*, 10*c* and of the lateral openings 11*a*, 11*b*, 11*c* around the axis of revolution X is substantially equal to 60°.

The sectors 10*a*, 10*b*, 10*c* connect a fixing head 12 for the plate 4 situated in the top zone of the suspension structure 3 to a bottom 13 situated in its bottom zone. The bottom 13 is generally plane and has a thick zone 14 on its top face extending between the sector 10*a* and the opposite opening 11*a*. A tongue 15 is cut out by means of a U-shaped slot in the thick zone 14. A stud 16 is formed on the bottom face of the tongue 15. The width of the thick zone 14 is equal to the distance between the two tongues 8*a* and 8*b* on the foot 2. The thickness of the bottom 13 outside the thick zone 14 is equal to the distance between the tongues 8*a*, 8*b* of the foot 2 and the top face 2*b* of said foot. To mount the suspension structure 3 on the foot 2, the openings 11*b*, 11*c* are put into register with the ends of the tongues 8*a* and 8*b* and the bottom 13 is slid under the tongues 8*a* and 8*b*. The tongues 8*a* and 8*b* are guided by the edges of the thick zone 14.

To enable the stud 16 of the bottom 13 to rise onto the top face 2*a* of the foot 2, a vertical force is applied to its end. Once the bottom 13 is fully engaged on the foot 2, the stud 16 moves down again on being received in the hole 9 of the base 2. The suspension structure 3 is then prevented from being pulled away by the tongues 8*a* and 8*b* which act as clamps, and it is prevented from turning about the axis X by the stud 16 received in the hole 9. The positioning of the stud 16 is naturally determined as a function of the position of the hole 9 relative to the axis X.

The head 12 of the suspension structure 17 is in the form of a neck having a through orifice 17 on the axis X. The head 12 is designed to be received in a central orifice 18 formed in the top plate 4. The peripheral wall of the head 12 is generally cylindrical and it terminates at the top end of the suspension structure 3 to form two radially opposite flange portions 19*a* and 19*b*. Respective axial ribs 20 are formed on the peripheral wall of the head 12 beneath each of the flange portions 19*a* and 19*b*. The head 12 is connected to the sectors 10*a*, 10*b*, 10*c* via an annular shoulder 21 serving as a support for the top plate 4.

Figure 7:
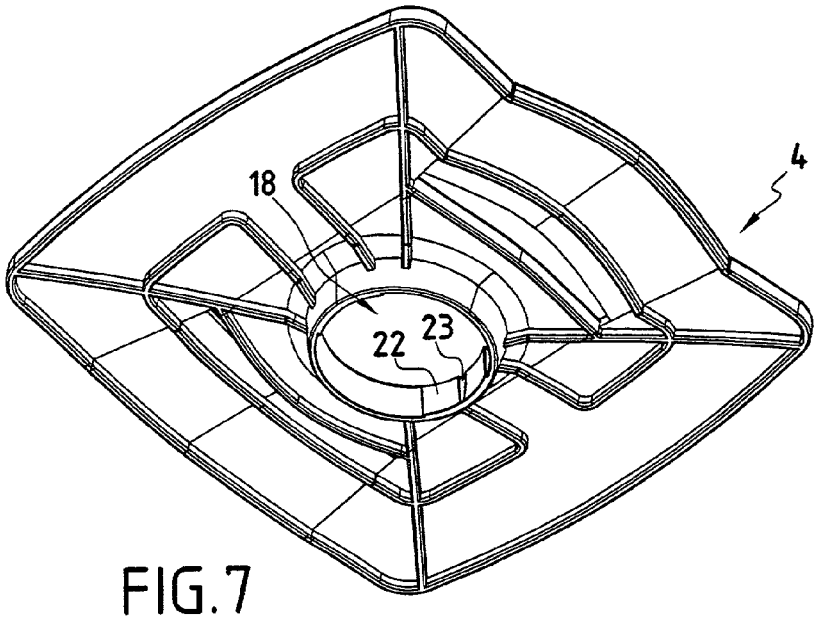
FIGS. 7 and 8 are perspective views showing respectively the bottom and top faces of the top plate of the FIG. 1 suspension device.
Figure 8:
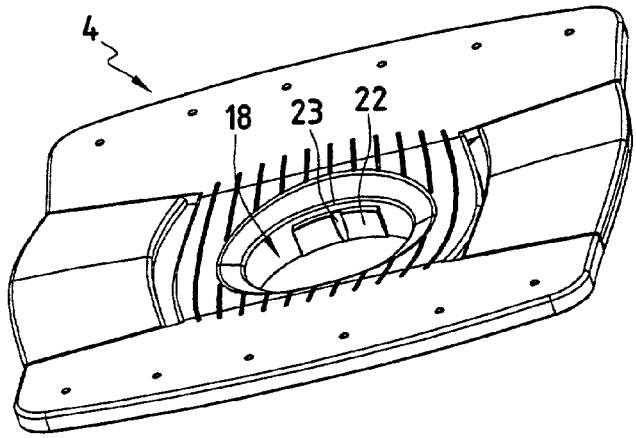

The top plate 4 which is shown in detail in FIGS. 7 and 8 is generally rectangular or square in shape. It could equally well have any other geometrical shape. The essential point is that the shapes of the top plates fitted to a base, for example, should be complementary and suitable for associating with one another. The plate 4 can be made of any kind of material, in particular of a thermoplastic material, wood, or in a multi-component laminate. It can be covered in cloth for reasons of appearance. It preferably has a plurality of slots or openings enabling air to pass through the padding element that it supports. Its central orifice 18 matches the dimensions of the fixing head 12 and its flange portions 19*a* and 19*b*. The central orifice 18 has diametrically opposite projections 22 which slide between the ends of the flange portions 19*a* and 19*b* while the plate 4 is being put into the fixing head 12. Each projection 22 has a groove 23 for co-operating with a rib 20 after the plate 4 has been turned through one-fourth of a turn about the axis X. The axial and circumferential dimensions of the projections 22 are such that after being turned through one-fourth of a turn about the axis X, the projections 22 are received under the flange portions 19*a* and 19*b*, and the grooves 23 co-operate with the ribs 20. This type of fastening is known, is referred to as a "bayonet" fastening, and requires no further explanation. After being put into place, the top plate 4 is prevented from moving relative to the suspension structure 3, both axially and in rotation.

Figure 9:
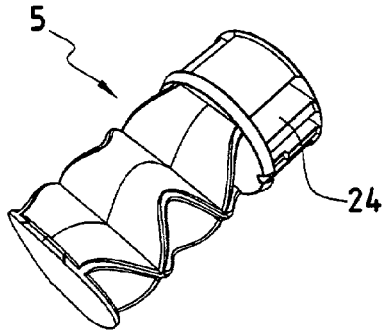
FIGS. 9 and 10 are perspective views of the stiffening member placed inside the suspension structure of the FIG. 1 device.
Figure 10:
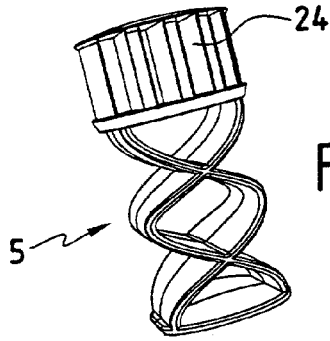

FIGS. 9 and 10 are detail views of a one-piece stiffening member 5 made by molding a material similar to the material used for making the suspension structure 3. This stiffening member 5 is inserted into the suspension structure 3 on its axis X via the orifice 17 in the head 12 for fixing the top plate 4. At its top end, this member comprises a plug 24 which closes the orifice 17. The plug 24 has means enabling it to be fixed in the orifice 17, for example by turning the stiffening member 5 relative to the suspension structure 3 during assembly. The stiffening member 5 is interposed between the bottom 13 and the head 12 for fixing the top plate 4. The stiffening member 5 serves to make the suspension harder in those zones of the base where loads are assumed to be greater. When the stiffening member 5 is not required, the orifice 17 of the fixing head 12 is closed by a cap 90, shown in FIG. 33.

Figure 11:
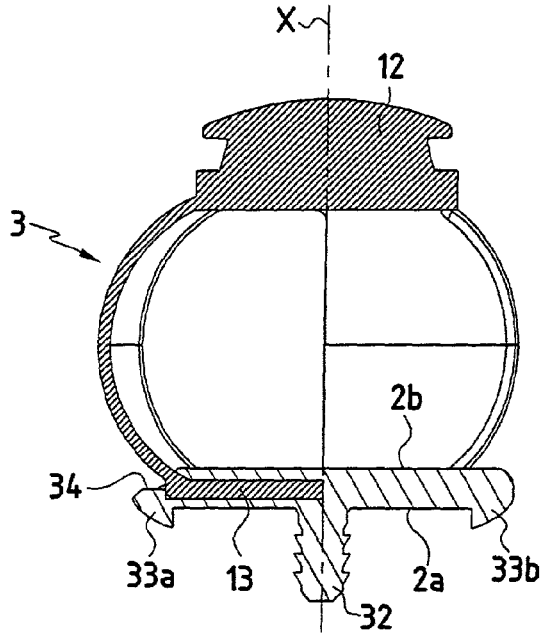
FIG. 11 is a section view on a vertical plane of symmetry through a first variant of the FIG. 1 suspension device.
Figure 12:
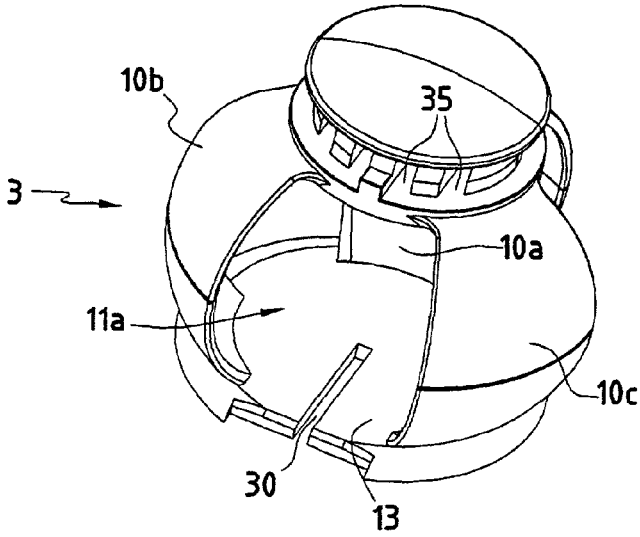
FIG. 12 is a perspective view of the suspension structure of the FIG. 11 device.
Figure 13:
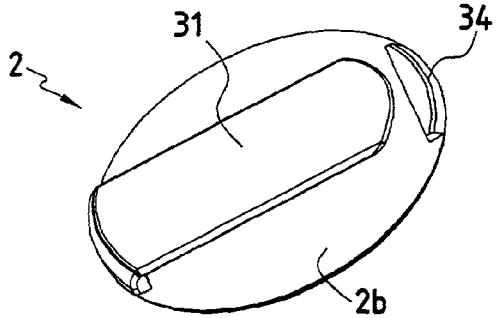
FIG. 13 is a perspective view of the foot of the FIG. 11 device.

FIGS. 11 to 13 show a first variant of the above-described suspension device. The bottom 13 of the suspension structure 3 is of uniform thickness and it presents a groove 30 facing the lateral opening 11*a* which serves to guide a middle wall connecting a tongue 31 formed on the top face 2*b* of the foot 2 to said foot 2. On its bottom face 2*a*, the foot 2 also has a tenon 32 for quick fastening to a slat, and two lateral hooks 33*a*, 33*b* which engage the edges of the slat, and on its top face 2*b* the foot has a clip device 34 facing the free end of the tongue 31 which serves to prevent the suspension structure 3 from moving relative to the foot 2 after assembly. The head 12 for fixing the top plate 4 is solid and at its periphery it has a plurality of housings 35 into which resilient fingers formed in the central orifice of the top plate 4 are clipped, as described in the Applicants' French patent application FR 98/00187, and which can be seen in the top plate 4 shown in FIG. 31.

Figure 14:
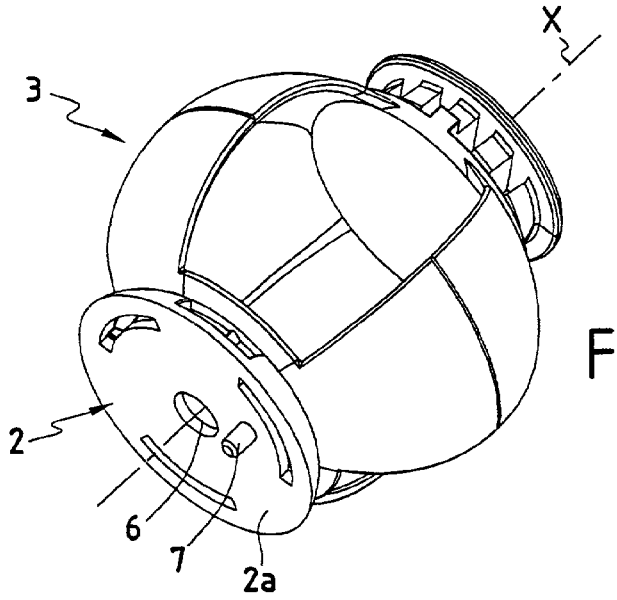
FIG. 14 is a perspective view of a second variant of the FIG. 1 suspension device.
Figure 15:
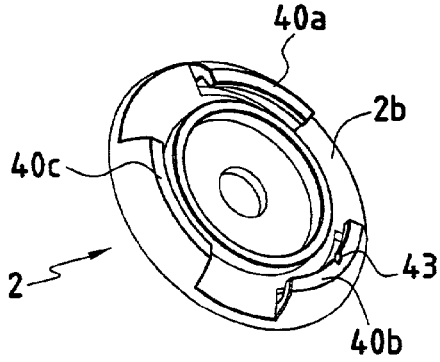
FIG. 15 is a perspective view of the foot of FIG. 14.
Figure 16:
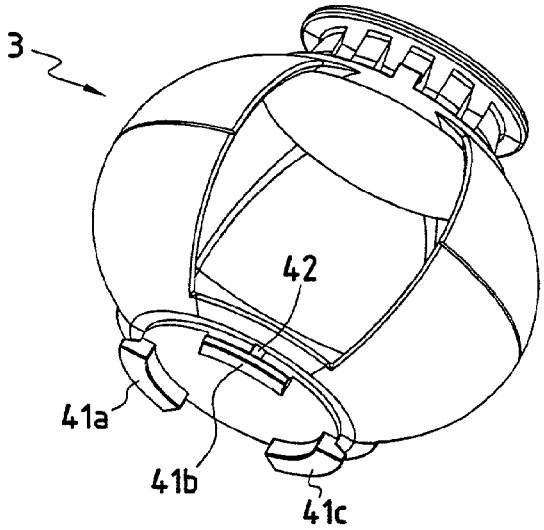
FIG. 16 is a perspective view from beneath of the suspension structure of FIG. 14.

FIGS. 14 to 16 show a second variant of the invention. The foot 2 has a central orifice 6 for receiving a screw for fixing it to a slat, and a stud 7 which projects from its bottom face 2*a* for preventing it from turning on the slat. The foot 2 can also have a plurality of studs 7 in alignment or a rib on its bottom face 2*a* so as to enable it to be docked blind in a groove formed in the slat so as to enable the foot 2 to be installed more accurately and more quickly on the platform that defines the support surface. The suspension structure 3 is fixed on the foot 2 by means of a bayonet fastening. For this purpose, the top face 2*b* of the foot 2 has three curvilinear hooks 40*a*, 40*b*, 40*c* facing towards the axis of the foot 2, and the bottom 13 presents three hooks 41*a*, 41*b*, 41*c* facing radially outwards and co-operating with the hooks 40*a*, 40*b*, 40*c* when the bottom is turned about its own axis X, then coinciding with the axis of the foot 2. Ribs 42 formed on top of the hooks 41*a*, 41*b*, 41*c* co-operate with grooves 43 formed in the hooks 40*a*, 40*b*, 40*c*, respectively, so as to prevent the suspension structure 3 from turning relative to the foot 2 once assembled therewith. As can be seen in FIGS. 14 to 16, the head 12 for fixing the top plate 4 is similar to that shown in FIGS. 11 and 12, however it could equally well be similar to that shown in FIGS. 2 and 6.

Figure 17:
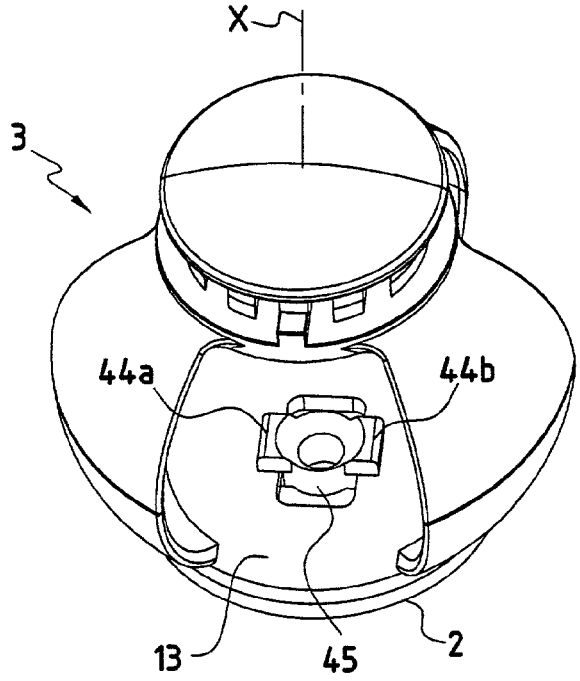
FIG. 17 is a perspective view of a third variant of the FIG. 1 suspension device.
Figure 18:
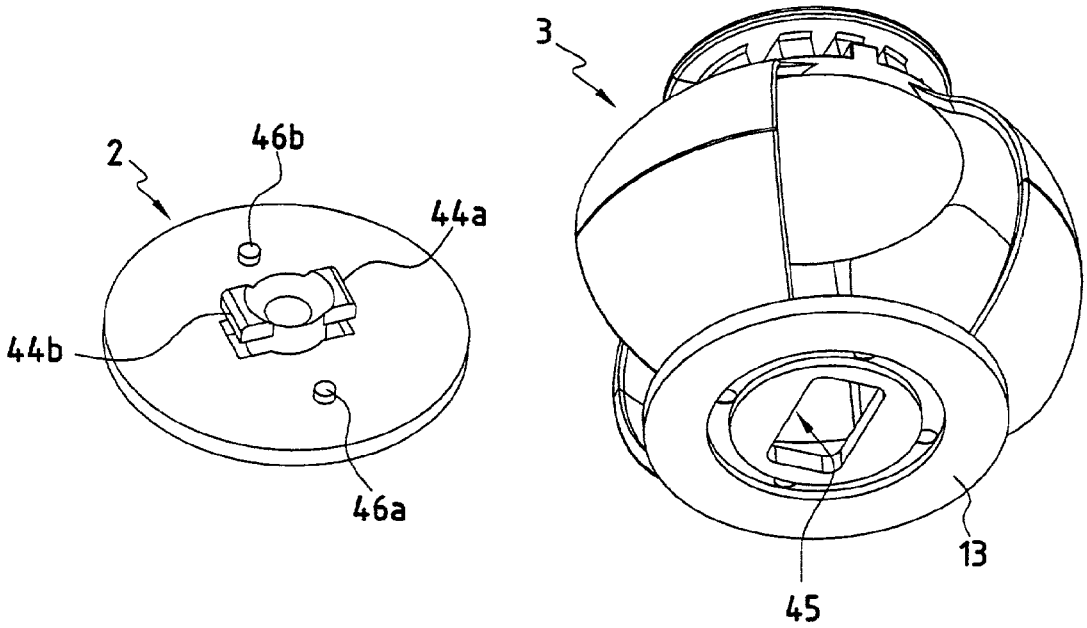
FIG. 18 is a perspective view of the top face of the foot of the FIG. 17 suspension device, and a view from beneath of the FIG. 17 suspension structure.

FIGS. 17 and 18 show a third variant of the invention. On its top face, the foot 2 has two opposite hooks 44*a* and 44*b* that are directed radially outwards and that engage the nearest walls of a rectangular opening 45 formed in the center of the bottom 13 of the suspension structure 3 and dimensioned so as to allow the hooks 44*a* and 44*b* to pass through. On its top face, the foot 2 also has two studs 46*a* and 46*b* which slide on circularly arcuate ramps formed in the bottom face of the bottom 13 and which are received in holes formed in the bottom face of the bottom 13 so as to lock the suspension structure 3 on the foot 2 after being turned through one-fourth of a turn.

Figure 19:
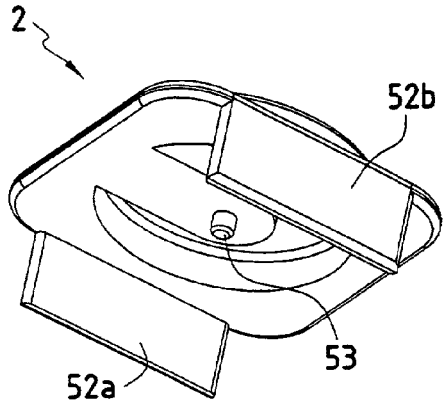
FIGS. 19 and 20 are perspective views respectively of the bottom face and of the top face of a foot in a fourth variant of the invention.
Figure 20:
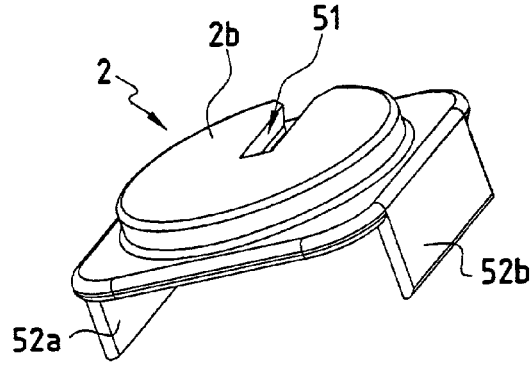
Figure 21:
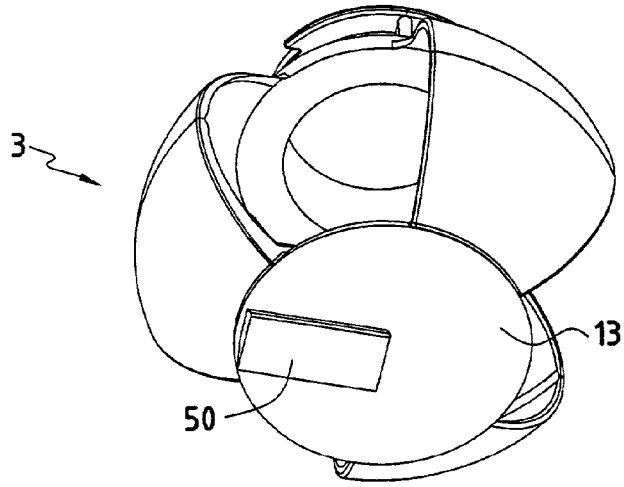
FIG. 21 is a perspective view of a suspension structure suitable for fitting on the foot of FIGS. 19 and 20.

In a fourth variant of the invention shown in FIGS. 19 to 21, the means for connecting together the suspension structure 3 and the foot 2 comprise a slideway of dovetail shape. For this purpose, the bottom 13 of the suspension structure 3 has a rib 50 on its bottom face, which rib is of dovetail section and extends from the axis X to the edge of the bottom 13, and is suitable for being slidably inserted into a groove 51 likewise of dovetail section formed in the top face 2*b* of the foot 2. The foot 2 also presents two parallel walls 52*a*, 52*b* projecting from its bottom face 2*a* suitable for being placed on either side of a slat, and a central stud 53 which is received in a hole formed in the slat.

Figure 22:
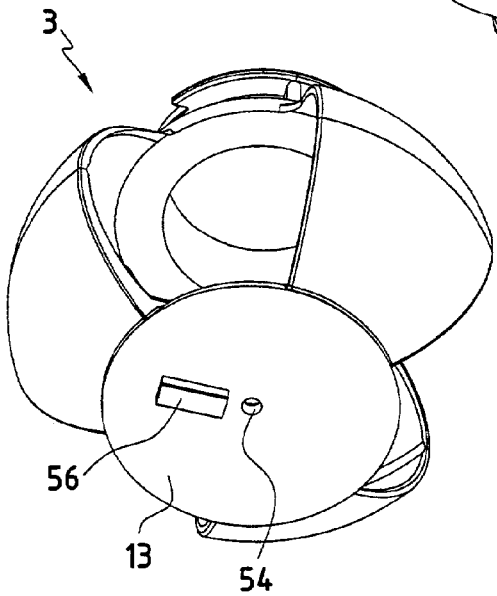
FIGS. 22 and 23 are perspective views respectively of a suspension structure and of a foot constituting a fifth variant of the invention.
Figure 23:
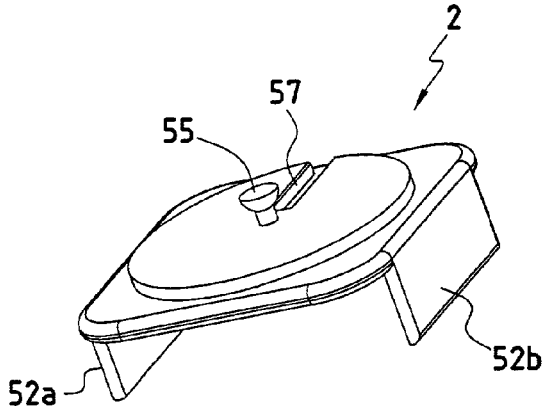

FIGS. 22 and 23 show a fifth variant of the invention. The bottom 13 of the suspension structure 3 has a central hole 54 in which a half-ball 55 formed on the top face 2*b* of the foot 2 can be clipped. A tenon 56 is formed on the bottom face of the bottom 13. This tenon 56 is received in a mortise 57 formed in the top face 2*b* of the foot 2, and serves to prevent the suspension structure 3 from turning relative to the foot 2. The foot 2 also has side walls 52*a* and 52*b* and a stud 53 as in the fourth variant, enabling it to be assembled on a slat and prevented from turning relative thereto.

Figure 24:
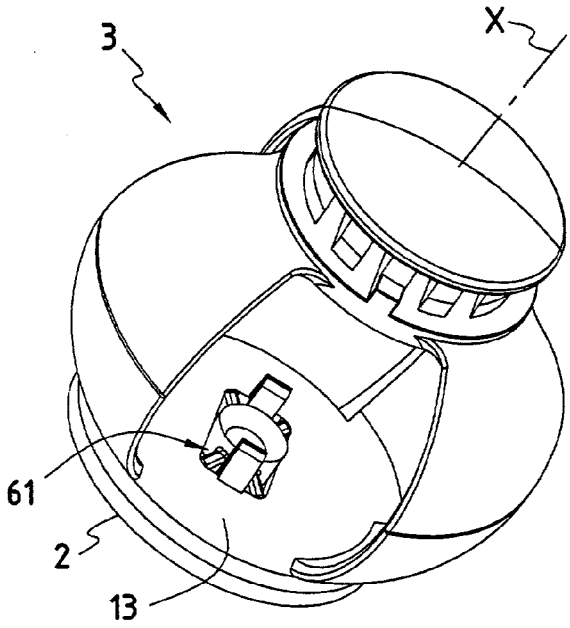
FIGS. 24 and 25 are perspective views respectively of a suspension structure and of a foot constituting a sixth variant of the invention.
Figure 25:
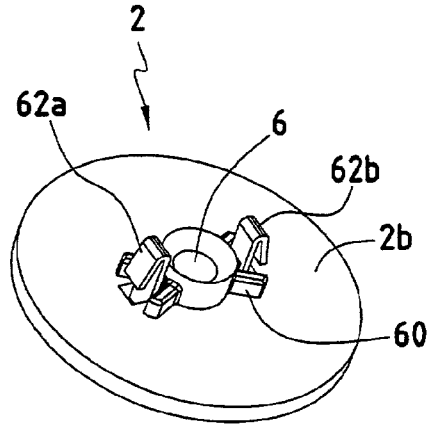

In a sixth variant of the invention shown in FIGS. 24 and 25, the foot 2 has a central orifice 6 in its top face 2*b* enabling it to be fixed to a slat by means of a screw. This central orifice is surrounded by a rectangular structure 60 which is received in a rectangular opening 61 formed in the center of the bottom 13. The rectangular structure 60 is fitted with resilient tongues 62*a* and 62*b* which engage the rims of the rectangular opening 61, as can be seen in FIG. 24.

Figure 26:
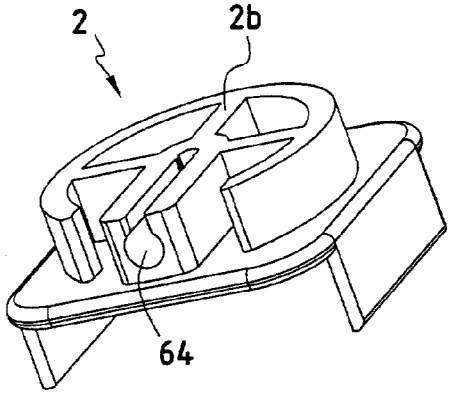
FIGS. 26 and 27 are perspective views respectively of a suspension structure and of a foot constituting a seventh variant of the invention.
Figure 27:
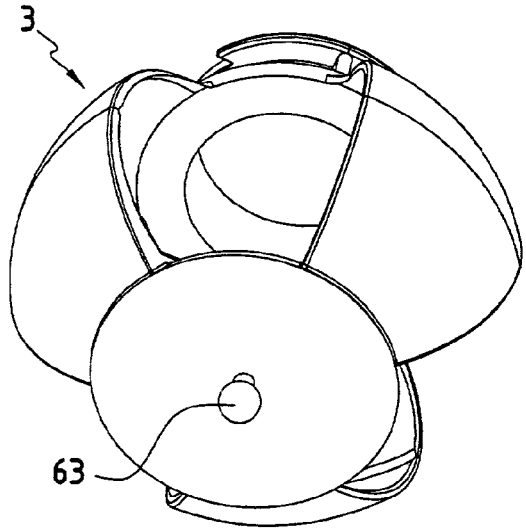
Figure 28:
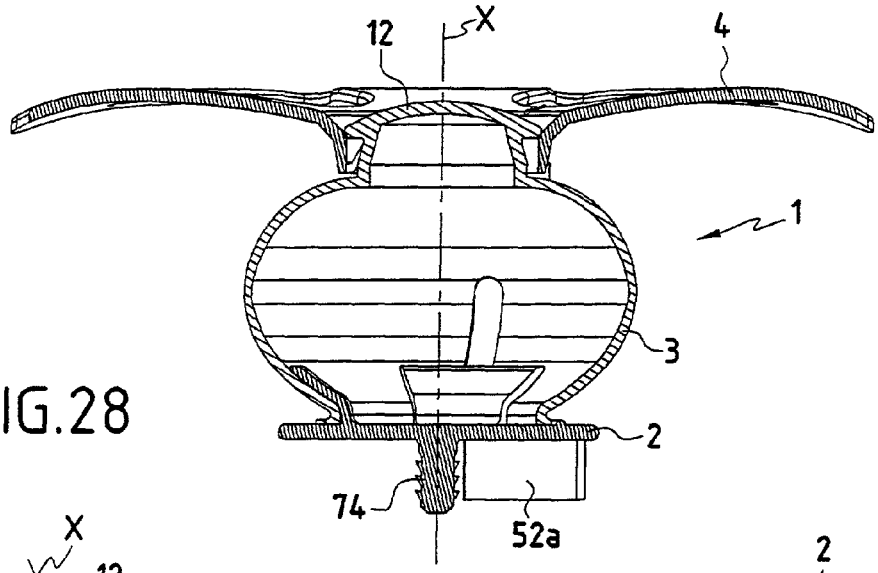
FIG. 28 is a section view on a vertical transverse plane showing a second embodiment of a suspension device of the invention.

FIGS. 26 and 27 show a seventh variant of the invention. The bottom face of the bottom 13 presents a central ball 63 which can be slid along a radial groove 64 formed in the top face 2*b* of the foot 2. Other means (not shown in FIG. 27) serve to prevent the suspension structure 3 from turning relative to the foot 2 after being assembled thereto.

Figure 29:
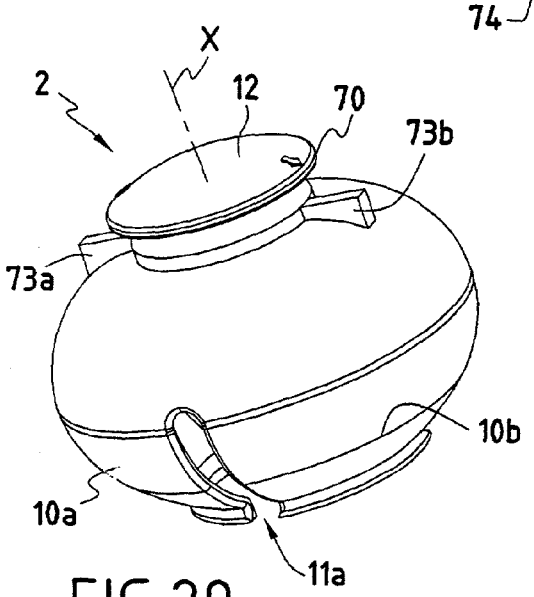
FIG. 29 is a perspective view of the suspension structure of the FIG. 28 device.
Figure 30:
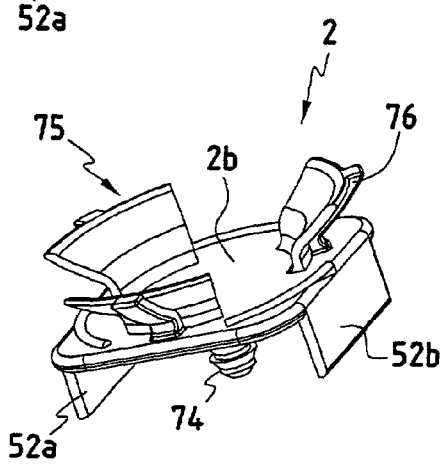
FIG. 30 is a perspective view of the foot of the FIG. 28 device.
Figure 31:
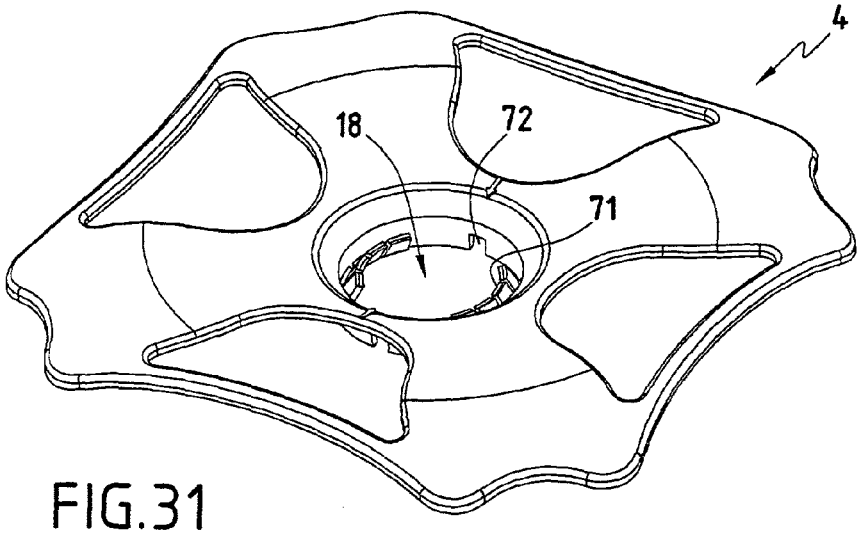
FIG. 31 is a perspective view of the top plate of the FIG. 28 device.

FIGS. 28 to 31 show a second embodiment of the invention. This suspension device 1 likewise comprises a foot 2 as shown in FIG. 30, a suspension structure 3 of spherical shape as shown in FIG. 29, and a top plate of square shape as shown in FIG. 31. The suspension structure 3 presents a head 12 for fixing the top plate 4, which head has a cylindrical wall terminated by an annular flange 70 for retaining resilient fingers 71 provided on the inside wall of the central orifice 18 in the top plate 4. The inside wall of this orifice 18 also has notches 72 suitable for being placed astride opposite radial ribs 73*a* and 73*b* formed in the top portion of the sphere at the bottom of the head 12 so as to prevent the top plate 4 turning about the axis X relative to the suspension structure 3 after they have been assembled together.

In its bottom hemisphere, the suspension structure 3 has three sectors 10*a*, 10*b*, and 10*c* which are separated by slots 11*a*, 11*b*, and 11*c* of small circumferential extent. Compared with the first embodiment, the suspension structure 3 does not have a bottom member 13 in its bottom zone. The bottom ends of the sectors 10*a*, 10*b*, and 10*c* are thus free. Beneath its bottom face, the foot 2 has side walls 52*a* and 52*b* suitable for receiving a slat between them, and it has a tenon 54 for fixing it to the slat, while on its top face 2*b* it has an upwardly flared neck 75 made up of three elements that are regularly spaced apart around the axis of the foot 2, each presenting an upwardly-extending rib 76 on its outside face of circumferential size matching the width of a slot 11*a*, 11*b*, or 11*c*. When the bottom ends of the sectors 10*a*, 10*b*, and 10*c* are urged elastically outwards, it is possible to fit the bottom portion of the suspension structure 3 over the neck 75 so that the ribs 76 are received in the slots 11*a*, 11*b*, and 11*c*.

Figure 32:
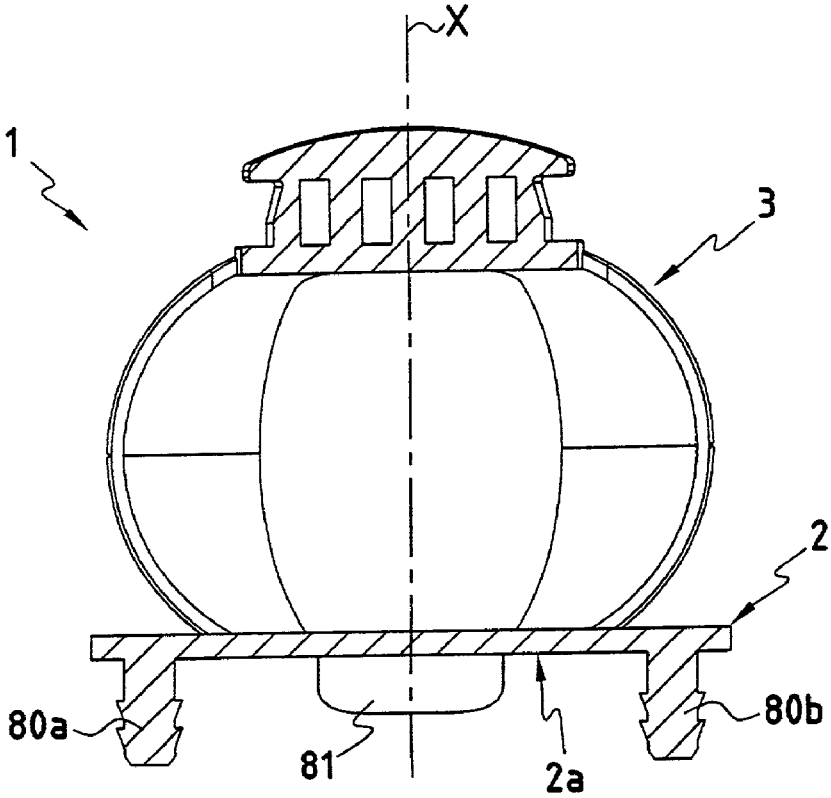
FIG. 32 is a section through a third embodiment of the invention.

FIG. 32 shows a third embodiment of the invention. In this case the foot 2 and the suspension structure are made as a single piece. The foot 2 presents two tenons 80*a* and 80*b* on its bottom face 2*a* enabling it to be fastened quickly in holes formed in a slat, and optionally an abutment 81 which bears against a side face of the slat.

Figure 33:
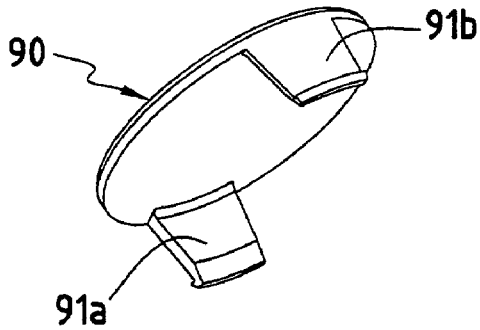
FIG. 33 is a perspective view of a cap suitable for the first embodiment of the invention as shown in FIGS. 1 to 10.
Figure 34:
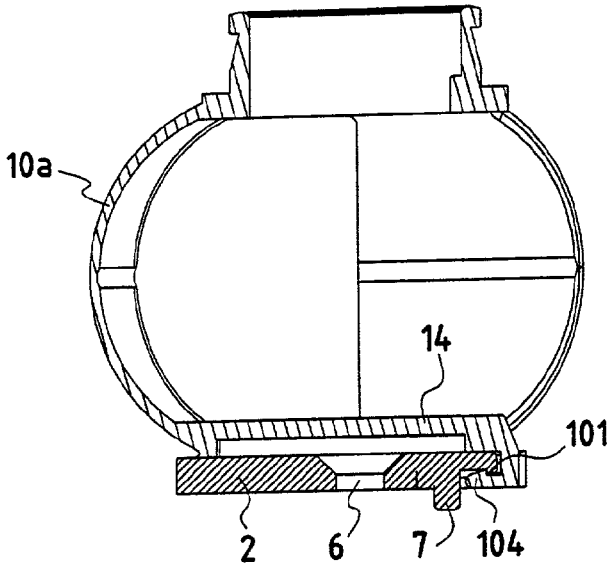
FIG. 34 is a section view on a vertical transverse plane through an eighth variant of the first embodiment of the invention.
Figure 35:
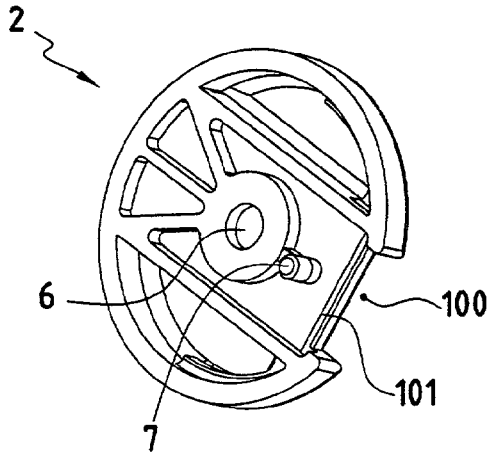
FIGS. 35 and 36 are perspective views respectively showing the bottom and top faces of the foot of the FIG. 34 variant.
Figure 36:
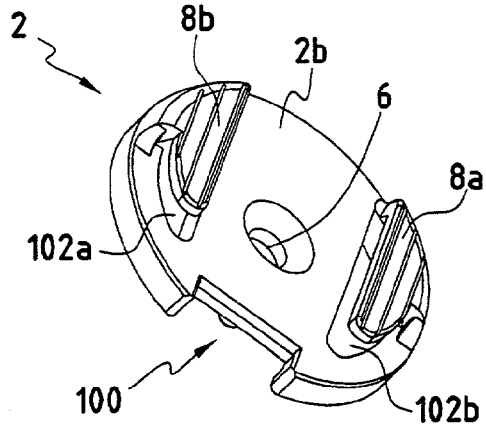

FIG. 33 shows a cap 90 having two tabs 91*a* and 91*b* suitable for sliding into the gap between the flange portions 19*a* and 19*b* of the head 12 and the projections 22 of the top plate 4 in the first embodiment of the invention as described above after the top plate 4 has been turned through one-fourth of a turn and non-return snap-fastening has taken place. The cap 90 can be made of overmolded cloth or as a piece of plastics material worked by thermocompression. It can carry attractive markings or decoration.

FIGS. 34 to 38 show an eighth variant of the suspension device as described with reference to FIGS. 1 to 10. The foot 2 differs from that shown in FIGS. 3 and 4 by the fact that it has a notch 100 in its periphery extending between the free ends of the lateral tongues 8*a* and 8*b*. On its bottom face 2*a*, extending along the notch 100, it also has a flange 101 situated above the support surface of the slat. The top face 2*b* of the foot 2 does not have the hole 9 shown in FIG. 4. This top face 2*b* presents portions of extra thickness 102*a* and 102*b* in register with the lateral tongues 8*a* and 8*b*.

Figure 37:
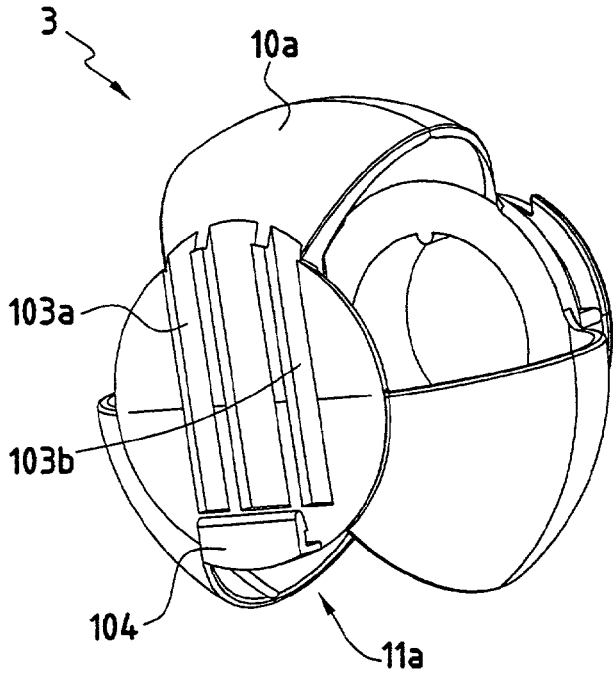
FIGS. 37 and 38 are perspective views respectively showing the bottom and top faces of the suspension structure of the FIG. 34 device.
Figure 38:
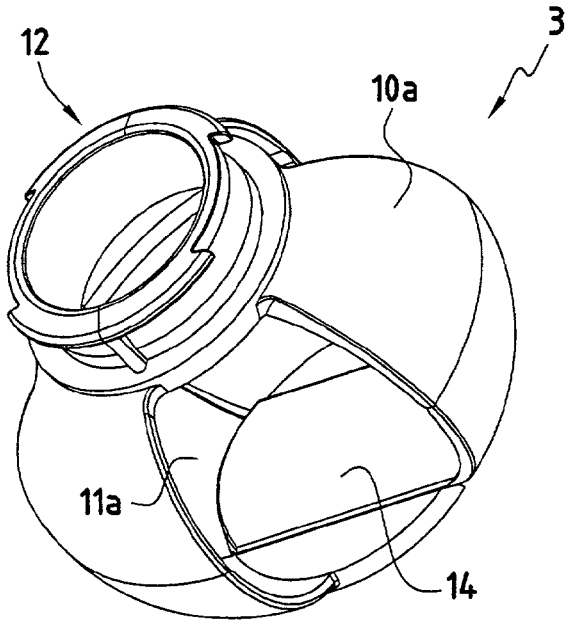

The suspension structure 3 fitted onto the foot 2 and shown in detail in FIGS. 37 and 38 has a fixed zone 14 on the top face of the bottom 13 like the suspension structure 3 shown in FIGS. 5 and 6, which thick zone is located between the lateral tongues 8*a* and 8*b* once the suspension structure 3 has been mounted on the foot 2, and on the bottom face of the bottom 13 it has parallel ribs 103*a* and 103*b* which are located between the portions 102*a* and 102*b* of extra thickness on the top face 2*b* of the foot, once the suspension structure 3 has been mounted on the foot 2. The ribs 103*a* and 103*b* are placed beneath the thick zone 14 and they are parallel to the side edges of said thick zone 14. Beneath the bottom face of the bottom 13, and in register with the lateral opening 11*a*, the suspension structure 3 also presents a hook 104 which engages in the notch 100 and whose end co-operates with the flange 101 to lock the suspension structure 3 on the foot 2. The suspension structure 3 is similar to that shown in FIGS. 5 and 6 concerning its sectors 10*a*, 10*b*, 10*c*, its lateral openings 11*a*, 11*b*, 11*c*, and its head 12 for fixing a top plate 4.

Figure 39:
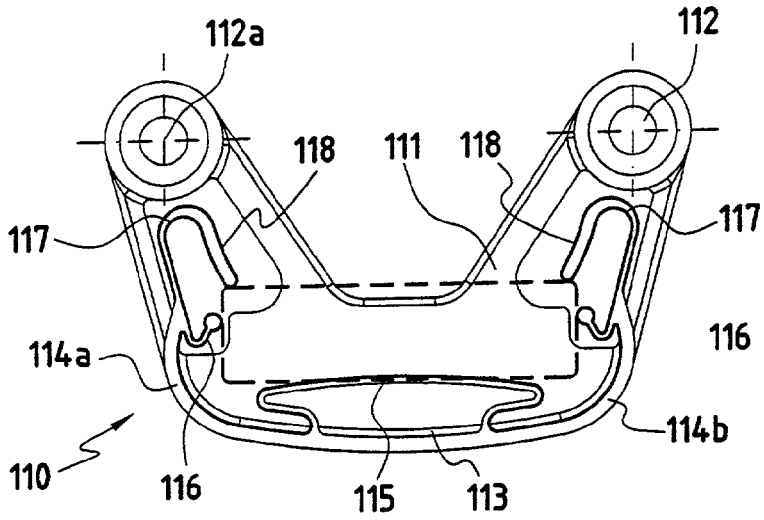
FIG. 39 is a side view of the inside face of a slat support.
Figure 40:
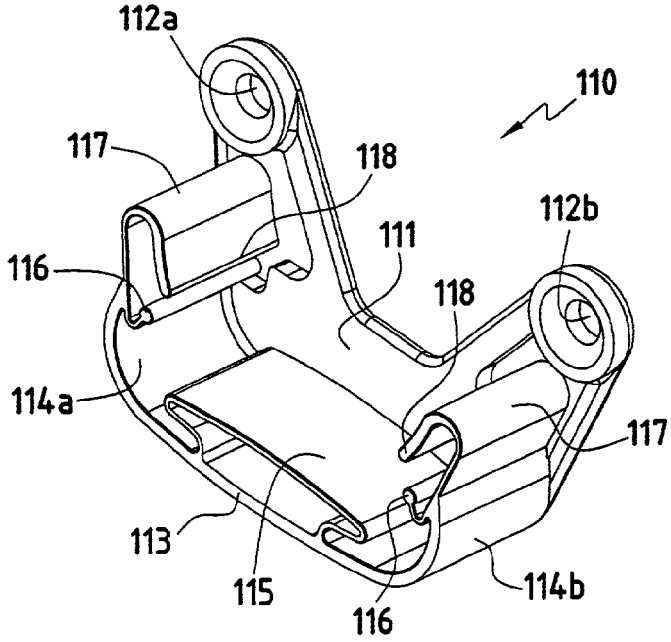
FIG. 40 is a perspective view of a slat support.

FIGS. 39 and 40 show a support 110 for one end of a slat of a base, the slat being represented by dashed lines. Suspension devices 1 as described above are mounted on such slats, being placed side by side. The support 110 has a vertical wall 111 for placing against the inside face of a long side member and for being fixed thereto by screws passing through orifices 112*a* and 112*b* formed in the wall 111, or by tenons formed on said vertical wall 111, or by a hooking angle member resting on the top face of the long side member. A cradle 113 extends horizontally from the bottom region of the vertical wall 111. The cradle 113 presents two end zones 114*a* and 114*b* that curve upwards. The middle zone of the cradle 113 carries a resilient tongue 115 which carries one end of a slat. At the end of each curved zone 114*a* and 114*b* there is provided a respective resilient element, namely a side lip 116 which bears against a corresponding flank of the slat, and an upside-down U-shaped resilient element 117 whose free end 118 bears against the top face of a slat.

The end of a slat is inserted from above into the space defined by the resilient tongue 115 and the ends of the lateral lips 116 and the resilient elements 117.

The lateral lips 116 clamp against the flanks of the slat, thus accommodating variations in manufacturing dimensions. The resilient elements 117 serve to prevent the slats from moving upwards, while the resilient tongue 115 compensates for variations in slat thickness and also serves to damp a set of suspension devices 1 fixed on the slat.

In the various embodiments of the invention as described above, the top plate 4 is in the form of a quadrangle and it is symmetrical about longitudinal and transverse planes containing the axis X. Clearly, the top plate 4 fitted to suspension devices 1 located at the edges of a base can carry top plates 4 of slightly different shape. In all cases, the systems for fixing the plate 4 to the head 12 of the suspension structure 3 enable the plate 4 to be held stationary relative to the structure 3 when subjected to traction along the axis X and when subjected to twisting about the axis X. The same applies to the systems for fixing the suspension structure 3 to the foot 2 and for fixing the foot 2 to a slat of the support platform.

What is claimed is:

1. An individual suspension device for a bed or seat base having a plurality of individual suspensions, the device being disposable between a platform defining a support surface and a padding element, and comprising:

a foot for fixing to an element of the platform;

a suspension structure fixed to the foot; and a top plate carried by the suspension structure and serving as a support for the padding element, said suspension structure being circularly symmetrical about a vertical axis thereof;

wherein said suspension structure when at rest is in the form of a one-piece hollow sphere comprising a plurality of sectors separated from one another by lateral openings and made of one of a flexible synthetic material and a vulcanized rubber of hardness lying in the range of from 40 on the Shore A scale to 70 on the Shore D scale;

wherein the suspension structure and the top plate have co-operating means for connecting them together in traction and in rotation about said vertical axis of said suspension structure;

wherein the suspension structure has a head at its top end for fixing the top plate, the head being received in an orifice formed in the top plate;

wherein the head has a through-orifice formed on the vertical axis of the suspension structure; and p1 wherein the suspension structure includes a removable stiffening member placed on said vertical axis, said stiffening member having a plug at its top end, and said plug being received in the through-orifice of the head.

2. A device according to claim 1, wherein the padding element is a mattress.

3. A device according to claim 1, wherein the suspension structure and the foot include co-operating means for connecting them together in traction and in rotation about the axis of symmetry of said suspension structure.

4. A device according to claim 3, wherein the suspension structure is in the form of a sphere having a plurality of sectors separated by lateral openings that are regularly spaced apart around the axis of symmetry of said suspension structure.

5. A device according to claim 4, wherein the sectors are connected to a bottom member situated in the bottom zone of the suspension structure.

6. A device according to claim 5, wherein the co-operating means providing connection between the suspension structure and the foot are formed in the bottom and the top face of the foot.

7. A device according to claim 6, wherein the co-operating means providing connection between the suspension structure and the foot comprise two lateral tongues forming clamps and formed on the top face of the foot, being designed to engage the bottom member, and a locking system for preventing the suspension structure from moving relative to the foot after assembly.

* * * * *